US006988681B2

(12) United States Patent
Reiter

(10) Patent No.: US 6,988,681 B2
(45) Date of Patent: Jan. 24, 2006

(54) FUEL INJECTION VALVE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 83 days.

(21) Appl. No.: 10/240,510

(22) PCT Filed: Jan. 28, 2002

(86) PCT No.: PCT/DE02/00295

§ 371 (c)(1),
(2), (4) Date: Apr. 29, 2003

(87) PCT Pub. No.: WO02/061269

PCT Pub. Date: Aug. 8, 2002

(65) Prior Publication Data

US 2003/0164411 A1 Sep. 4, 2003

(30) Foreign Application Priority Data

Jan. 30, 2001 (DE) ..... 101 03 933

(51) Int. Cl.
*B05B 1/30* (2006.01)

(52) U.S. Cl. ..... 239/584; 239/533.3; 239/533.12; 239/585.1; 239/600; 123/470

(58) Field of Classification Search ..... 239/533.2, 239/533.3, 584, 533.12, 600, 585.1; 123/470; 285/305, 382, 382.4, 382.5, 921; 403/282, 403/292

See application file for complete search history.

(56) References Cited

U.S. PATENT DOCUMENTS

| | | | | |
|---|---|---|---|---|
| 1,802,538 A | | 4/1931 | Rych | |
| 3,967,597 A | | 7/1976 | Schlagmuller et al. | |
| 4,007,880 A | * | 2/1977 | Hans et al. | 239/600 |
| 4,589,596 A | * | 5/1986 | Stumpp et al. | 239/533.2 |
| 4,938,193 A | | 7/1990 | Raufeisen et al. | |
| 5,173,986 A | * | 12/1992 | Bohmer et al. | 285/921 |
| 5,191,867 A | | 3/1993 | Glassey | |
| 5,247,918 A | | 9/1993 | Wakeman | |
| 5,301,877 A | * | 4/1994 | Madison | 239/600 |
| 5,345,913 A | | 9/1994 | Belshaw et al. | |
| 5,419,297 A | * | 5/1995 | Peterson et al. | 123/470 |
| 6,119,658 A | * | 9/2000 | Jehle et al. | 123/470 |
| 6,454,188 B1 | * | 9/2002 | Maier | 239/533.12 |

FOREIGN PATENT DOCUMENTS

| | | |
|---|---|---|
| DE | 198 08 068 | 9/1999 |
| DE | 198 41 155 | 1/2000 |
| DE | 198 49 210 | 4/2000 |
| DE | 199 00 405 | 7/2000 |
| DE | 299 09 564 | 11/2000 |

* cited by examiner

*Primary Examiner*—Steven J. Ganey
(74) *Attorney, Agent, or Firm*—Kenyon & Kenyon

(57) ABSTRACT

A fuel injector for fuel injection systems of internal combustion engines includes a nozzle body. At a downstream end of the nozzle body at least one spray discharge opening is arranged. A sealing element is arranged on the nozzle body for sealing with respect to a contiguous component. At least one circumferential sealing ridge that forms a press fit with a contiguous component is arranged on the nozzle body as the sealing element.

7 Claims, 2 Drawing Sheets

FUEL INJECTION VALVE

FIELD OF THE INVENTION

The present invention relates to a fuel injector.

BACKGROUND INFORMATION

A fuel injector that includes a nozzle body which is tubular on its downstream side, and at whose downstream end a sealing seat and a spray discharge opening are positioned, is described in German Published Patent Application No. 198 49 210. The tubular portion of the nozzle body is insertable into a receiving bore of a cylinder head. The nozzle body is sealed with respect to the receiving bore of the cylinder head, which has a diameter corresponding to the radial extension of the nozzle body, with a seal that has approximately the geometry of a hollow cylinder.

For positional retention of the seal on the nozzle body, the nozzle body includes a circumferential groove which is made, for example, by turning down the nozzle body and into which the seal is inserted. Elastic materials that may be slid over the nozzle body for installation in the groove may be used as materials.

A further fuel injector, in which a sealing element is positioned on the nozzle body, is described in German Published Patent Application No. 198 08 068. The seal is made of a metallic material, and expands in the radial direction under the influence of the temperature created by the combustion process. This may be implemented either by manner of a shape-memory alloy or the use of a bimetallic seal. A groove in the nozzle body may be used for retention, as in the case of German Published Patent Application No. 198 49 210.

During operation of the internal combustion engine, the metal sealing ring heats up and expands. The sealing effect is thus enhanced during operation. For easier assembly, the metal seal has a slightly smaller diameter than the receiving bore that is introduced into the cylinder head for the fuel injector.

A disadvantage of the sealing approach described in German Published Patent Application No. 198 49 210 is the high temperature acting on the seal. With direct-injection internal combustion engines, full-throttle strength of non-metallic seal materials may not be ensured.

The approach described in German Published Patent Application No. 198 08 068 has the disadvantage that the sealing effect of the metallic seal is temperature-dependent. After a cold start of the internal combustion engine, it takes some time for the materials in the vicinity of the combustion chamber to be heated by the combustion process sufficiently to reach, by thermal conduction, a temperature in the seal that results in the requisite geometrical change. In addition to the seal described, a further seal is used in order to seal the combustion chamber with respect to the exterior during initial operation of the internal combustion engine, so that compression pressure is not lost.

The complex materials that are used in the manufacture of metallic seals which deform in temperature-dependent fashion are also disadvantageous. A shape-memory alloy has a transition temperature matched to the application. Close tolerances in the manufacturing process are useful in guaranteeing this transition temperature. The result is to increase not only development costs for the alloy but also costs for utilization in series production.

The use of a bimetallic seal requires retention of the seal on a nozzle body, which serves as countermember upon deformation. Installation of the bimetallic element e.g. in a groove is difficult, however, since the properties of the metals change if one of the two metals experiences an inelastic deformation during installation

SUMMARY OF THE INVENTION

The fuel injector according to the present invention may provide the advantage that only a change in the geometry of the nozzle body results in sealing. Because the sealing ridges are configured in one piece with the nozzle body, the seal is required to have a sealing function only with regard to the contiguous component. Another consequence is that no materials that may be damaged as a result of the temperatures that occur are used in the immediate vicinity of the combustion chamber. The purely metallic seal is a constituent of a component that is used in any case, so that furthermore no additional corrosion protection (for example, due to possible contact corrosion) is necessary.

The one-piece configuration reduces the production complexity of the fuel injector, and moreover ensures low rejection rates because one assembly step may be omitted.

The successive positioning of multiple sealing ridges may be advantageous especially in terms of the reliability of the sealing effect. The identical geometry of the individual enlargements simplifies manufacture, so that tool costs may be reduced.

It may be additionally advantageous that an increase in the number of sealing elements does not result in an increase in the number of components of the fuel injector. The sealing ridges may be machined in different quantities out of the same nozzle body blank.

The use of an adapter sleeve as contiguous component may allow the sealing of the unit comprising the fuel injector plus adapter sleeve with respect to the cylinder head to be shifted to a location that is less critical in terms of temperature.

An example embodiment of a fuel injector according to the present invention is depicted in the drawings and is explained in the description below.

DETAILED DESCRIPTION

Figure 1:
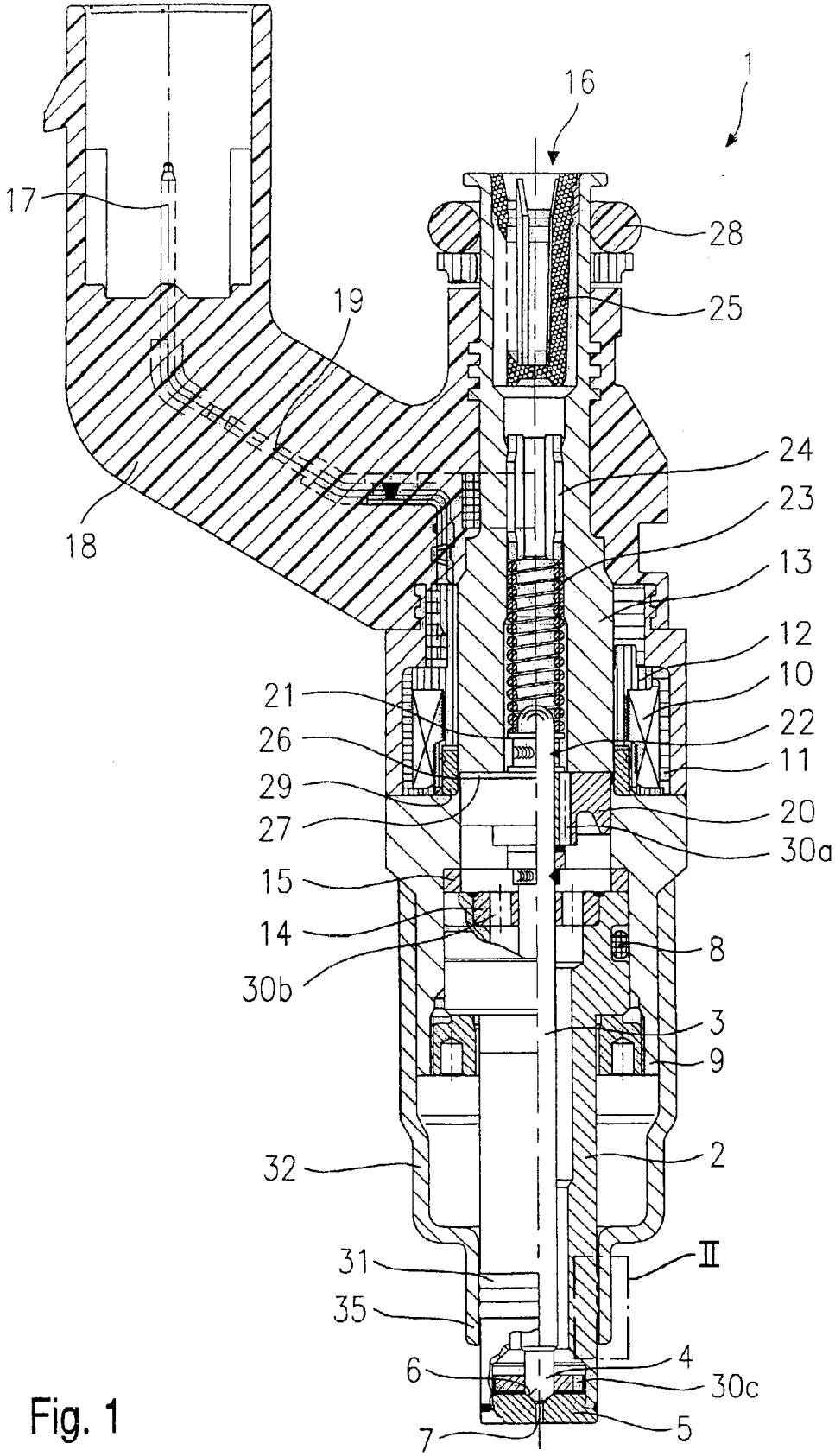
FIG. 1 is a schematic partial section through an example embodiment of a fuel injector according to the present invention.

For better comprehension of the present invention, an example embodiment of a fuel injector 1 according to the present invention will first be explained briefly with reference to FIG. 1 in an overall presentation in terms of its constituents.

Fuel injector 1 is embodied in the form of a fuel injector 1 for fuel injection systems of mixture-compressing, sparkignited internal combustion engines. Fuel injector 1 is suitable for direct injection of fuel into a combustion chamber (not depicted) of an internal combustion engine.

Fuel injector 1 includes a nozzle body 2 in which a valve needle 3 is positioned. Valve needle 3 is in working engagement with a valve closure element valve-closure member which coacts with a valve-seat surface 6, positioned on a valve seat element 5, to form a sealing seat. In the example embodiment, fuel injector 1 is an electromagnetically actuated fuel injector 1 that possesses at least one spray discharge opening 7. Nozzle body 2 is sealed by a seal 8 with respect to an external pole 9 of a magnet coil 10. Magnet coil 10 is encapsulated in a coil housing 11 and wound onto a coil support 12 that rests against an internal pole 13 of magnet coil 10. Internal pole 13 and external pole 9 are separated from one another by a gap 26, and are supported on a connecting component 29. Magnet coil 10 is energized, via a conductor 19, by an electrical current that may be conveyed via an electrical plug contact 17. Plug contact 17 is surrounded by a plastic sheath 18 that may be injection-molded onto internal pole 13.

Valve needle 3 is guided in a valve needle guide 14 that is of disk-shaped configuration. Paired with the latter is an adjusting disk 15 that serves to adjust the valve needle stroke. Located on the upstream side of adjusting disk 15 is an armature 20. The latter is joined nonpositively, via a flange 21, to valve needle 3, which is joined to flange 21 by manner of a weld seam 22. Braced against flange 21 is a return spring 23 which, in the present configuration of fuel injector 1, is preloaded by a sleeve 24 pressed into internal pole 13.

Fuel conduits 30*a* through 30*c* extend in valve needle guide 14, in armature 20, and in a guidance disk 31. A filter element 25 is positioned in a central fuel inlet 16. Fuel injector 1 is sealed with respect to a fuel line (not depicted) by manner of a seal 28.

When fuel injector 1 is in the idle state, armature 20 is impinged upon opposite to its linear stroke direction, via flange 21 on valve needle 3, by return spring 23, so that valve-closure member 4 is held in sealing contact on valve seat 6. Upon energization of magnet coil 10, the latter establishes a magnetic field that moves armature 20 in the linear stroke direction against the spring force of return spring 23, the linear stroke is defined by a working gap 27 that is present, in the idle position, between internal pole 13 and armature 20. Armature 20 also entrains flange 21, which is welded to valve needle 3, in the linear stroke direction. Valve-closure member 4 lifts off from valve-seat surface 6, and fuel is discharged from spray discharge opening 7.

When the coil current is shut off and once the magnetic field has decayed sufficiently, armature 20 falls away from internal pole 13 onto flange 21 as a result of the pressure of return spring 23, thereby moving valve needle 3 against the linear stroke direction. Valve-closure member 4 is thereby placed onto valve-seat surface 6, and fuel injector 1 is closed.

Fuel injector 1 according to the present invention is sealed with respect to an adapter sleeve 32 by manner of at least one sealing ridge 31 that is positioned as a radial enlargement on nozzle body 2. Instead of adapter sleeve 32 depicted in the example embodiment, any contiguous component may be used. Adapter sleeve 32 may allow fuel injectors 1 to be installed into a cylinder head that would require changes to the outside dimensions of fuel injector 1. Adapter sleeve 32 includes at its downstream end a tubular part 35, the inner radial extension of tubular part 35 corresponding to the outer radial extension of nozzle body 2. Tubular part 35 has a cylindrical inner contour. Adapter sleeve 32 is sealed with respect to the cylinder head in a manner that is not depicted.

The length of tubular part 35 of adapter sleeve 32 is at least sufficient that all the sealing ridges 31 provided for sealing of nozzle body 2 together include a smaller extension in the axial direction than tubular part 35 of adapter sleeve 32, and thus are positioned within tubular part 35. Sealing ridges 31, which are positioned circumferentially around cylindrical nozzle body 2 as radially enlarged regions, include an outer radial extension which is somewhat greater than the inner radial extension of tubular part 35 of adapter sleeve 32. When nozzle body 2 is inserted into adapter sleeve 32, a press-fit join which assumes the sealing function is thus produced between nozzle body 2 and adapter sleeve 32. Since adapter sleeve 32 is in turn sealed (in a manner not depicted) with respect to the cylinder head, it is not possible for the pressure in the combustion chamber (not depicted) to escape into its surroundings.

Nozzle body 2 is of cylindrical configuration, its outer radial extension (especially downstream of sealing ridges 31) is somewhat smaller than the outer radial extension of sealing ridges 31. The contact area between nozzle body 2 and adapter sleeve 32 is thereby limited to sealing ridges 31. The surface pressure resulting from the press-fit join and the small contact area ensures the sealing effect. Sealing ridges 31 positioned successively in the axial direction have identical cross sections.

Instead of adapter sleeve 32, fuel injector 1 may also be installed directly into a cylinder head of a direct-injection internal combustion engine. For that purpose, the cylinder head includes a receiving orifice for fuel injector 1 that corresponds, at least in a subregion, to the geometry of adapter sleeve 32, so that when fuel injector 1 is in the installed position, sealing ridges 31 of nozzle body 2 seal fuel injector 1 with respect to the receiving orifice of the cylinder head. As an alternative to the identical geometry of the individual sealing ridges 31 in the example embodiment depicted, sealing ridges 31 may also be embodied with differing cross sections.

Figure 2:
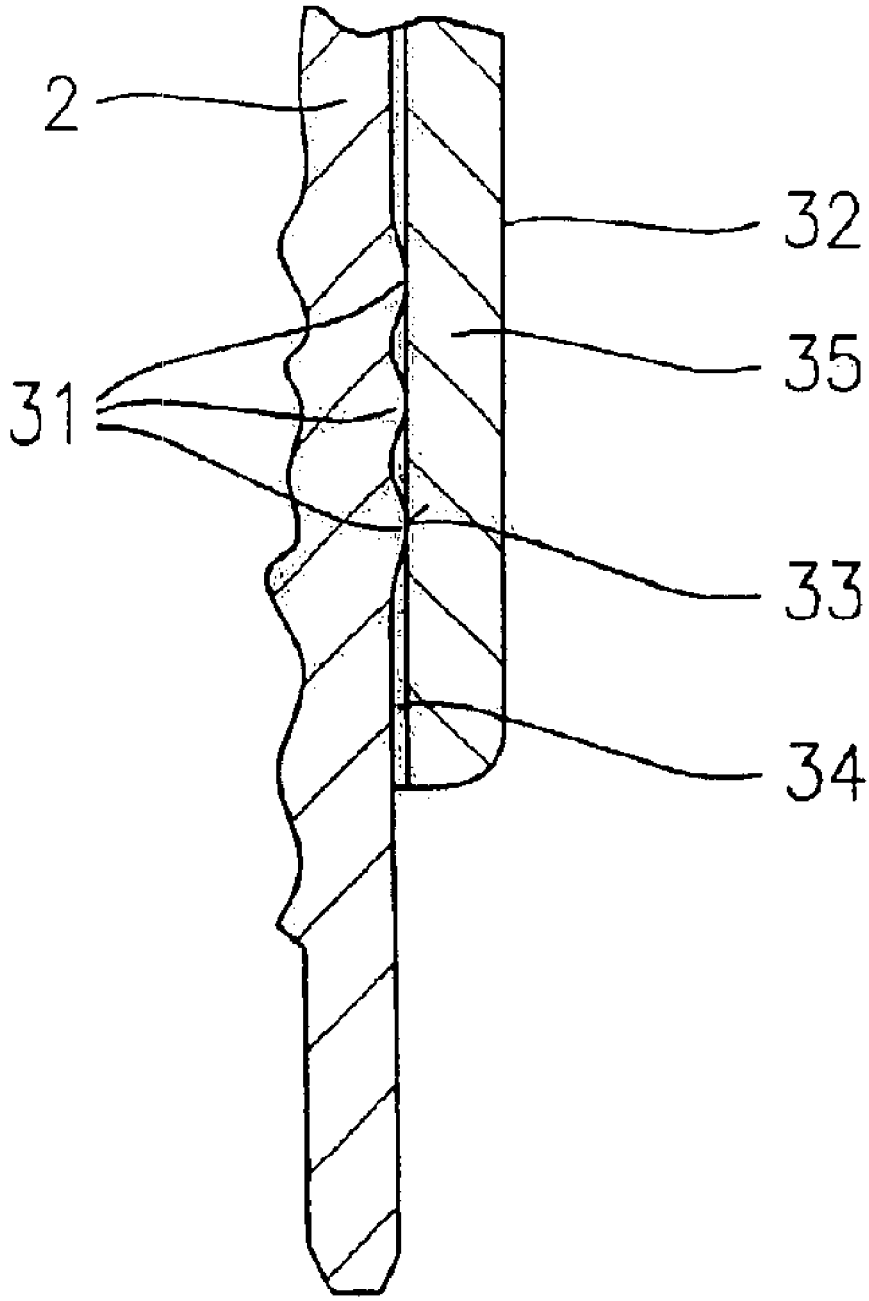
FIG. 2 is a schematic section, in portion II of FIG. 1, through the fuel injector according to the present invention.

FIG. 2 is an enlarged depiction of the sealing portion of nozzle body 2 shown in FIG. 1. Sealing ridges 31 constitute the only contact areas between nozzle body 2 and adapter sleeve 31, and thus generate the sealing surface pressure. Upstream and downstream from sealing ridges 31, an air gap 34 is formed as a result of the smaller radial extension of nozzle body 2 as compared to the inner radial extension of adapter sleeve 32.

External radii 33 of sealing ridges 31 in the region of the contact surface against adapter sleeve 32 are selected to be sufficiently large that chips may not be shaved off from adapter sleeve 32 upon assembly. Chip-free assembly is especially important in the context of direct installation into a cylinder head, since the metal chips would fall directly into the combustion chamber.

What is claimed is:

1. A fuel injector for a fuel injection system of an internal combustion engine, comprising:

a nozzle body that includes at least one spray discharge opening arranged at a downstream end of the nozzle body;

a contiguous component; and a sealing element configured to seal with respect to the contiguous component;

wherein the sealing element includes at least one circumferential sealing ridge that forms a press fit with the contiguous component; and wherein the nozzle body and sealing element are formed as a one-piece configuration and the sealing ridge is an integral radial enlargement of the downstream end of the nozzle body.

2. The fuel injector according to claim 1, wherein:

the at least one circumferential sealing ridge includes a plurality of sealing ridges arranged successively in an axial direction on the nozzle body.

3. The fuel injector according to claim 2, wherein:

the plurality of sealing ridges have an identical geometry.

4. The fuel injector according to claim 1, wherein:

the nozzle body, at least in a region of the at least one circumferential sealing ridge, is cylindrical as far as the downstream end.

5. The fuel injector according to claim 1, wherein:

the fuel injector is insertable with the downstream end of the nozzle body into the contiguous component.

6. The fuel injector according to claim 1, wherein:

the contiguous component includes an adapter sleeve that is slidable onto the fuel injector.

7. The fuel injector according to claim 1, further including an air gap on both a downstream and upstream side of each of the at least one sealing ridges between a surface of the contiguous component and a surface of the downstream end of the nozzle body.

* * * * *